US005793274A

United States Patent [19]

Kelly et al.

[11] Patent Number: 5,793,274

[45] Date of Patent: Aug. 11, 1998

[54] SURFACE MOUNT FUSING DEVICE

[75] Inventors: Kevin Kelly, Ballintemple; Chris Herbert, Cork, both of Ireland

[73] Assignee: Bourns, Inc., Riverside, Calif.

[21] Appl. No.: 742,163

[22] Filed: Nov. 1, 1996

[51] Int. Cl.[6] ..... H01H 85/02

[52] U.S. Cl. ..... 337/183; 337/141; 337/405; 337/407

[58] Field of Search ..... 337/295, 296, 337/297, 232, 273, 276, 280, 282, 186, 104, 105, 163, 164, 165, 166, 234, 236, 238, 239, 241, 244, 245, 265, 267, 243, 405, 402, 403, 404, 4, 152, 153, 183, 184, 185, 401–417; 29/623

[56] References Cited

U.S. PATENT DOCUMENTS

| | | | |
|---|---|---|---|
| 3,763,454 | 10/1973 | Zandonatti | 337/404 |
| 3,995,246 | 11/1976 | Morgan | 337/407 |
| 4,494,104 | 1/1985 | Holmes | 337/403 |
| 4,533,896 | 8/1985 | Belopolsky | 337/232 |
| 4,879,805 | 11/1989 | Tomkinson et al. | 29/622 |
| 5,084,691 | 1/1992 | Lester et al. | 337/297 |
| 5,097,247 | 3/1992 | Doerrwaechter | 337/405 |
| 5,192,937 | 3/1993 | Lee | 337/104 |
| 5,193,044 | 3/1993 | Czerwiec | 361/104 |
| 5,280,262 | 1/1994 | Fischer | 337/405 |
| 5,363,083 | 11/1994 | Fischer | 337/407 |
| 5,612,662 | 3/1997 | Drekmeier et al. | 337/389 |

FOREIGN PATENT DOCUMENTS

| | | | |
|---|---|---|---|
| WO 94/03913 | 2/1994 | Germany | 337/403 |

*Primary Examiner*—Michael W. Phillips
*Assistant Examiner*—Anatoly Vortman
*Attorney, Agent, or Firm*—Klein & Szekeres, LLP

[57] ABSTRACT

A thermal fuse device for over-current protection includes a fusing element comprising a conductive strip having a fulcrum point between first and second ends. The fuse strip is connected to first and second terminal pads on a substrate by a first solder joint between the first end and the first terminal pad, and a second solder joint between the fulcrum point and the second terminal pad. The second end of the strip is resiliently pressed against the interior surface of a housing that holds the substrate. The inwardly-directed pressure applied to the second end of the fuse strip by the housing is resisted by the first and second solder joints, whereby the fuse strip remains immobile. A resistive element on the substrate generates heat in response to the flow of current. When the current is greater than a predetermined current value, the generated heat melts the first and second solder joints, thereby allowing the fuse strip to pivot about its fulcrum point in response to the pressure applied to its second end by the housing, and thereby causing the first end of the fuse strip to separate from the first terminal pad to open the circuit. In a preferred embodiment, the housing holds two or more of the substrates in a substantially parallel relationship to each other and in a substantially perpendicular relationship to the circuit board, whereby the substrates can be installed on the board in an upright, surface mount orientation.

17 Claims, 3 Drawing Sheets

FIG. 2
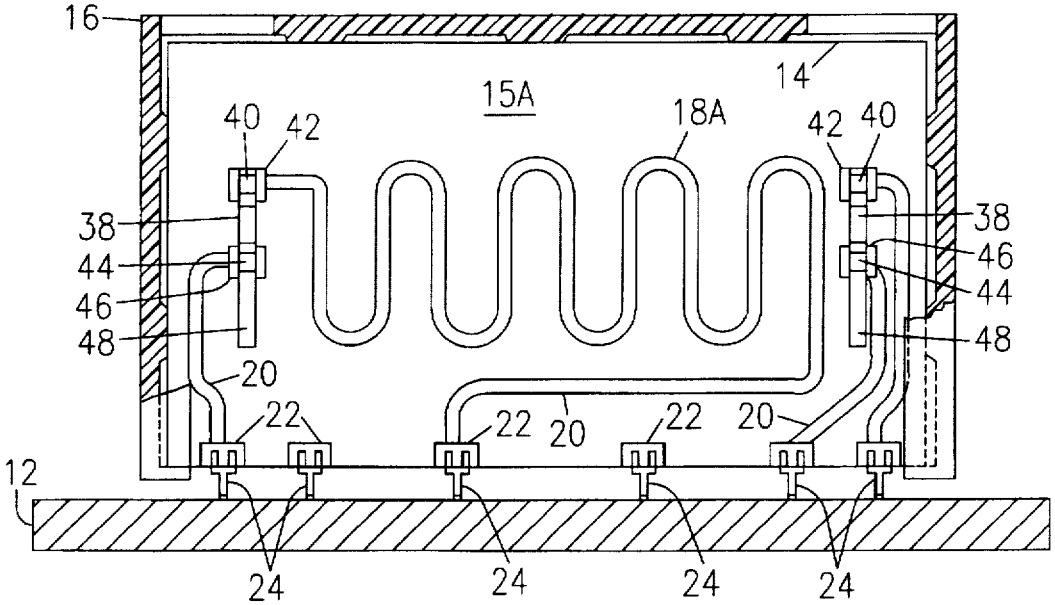
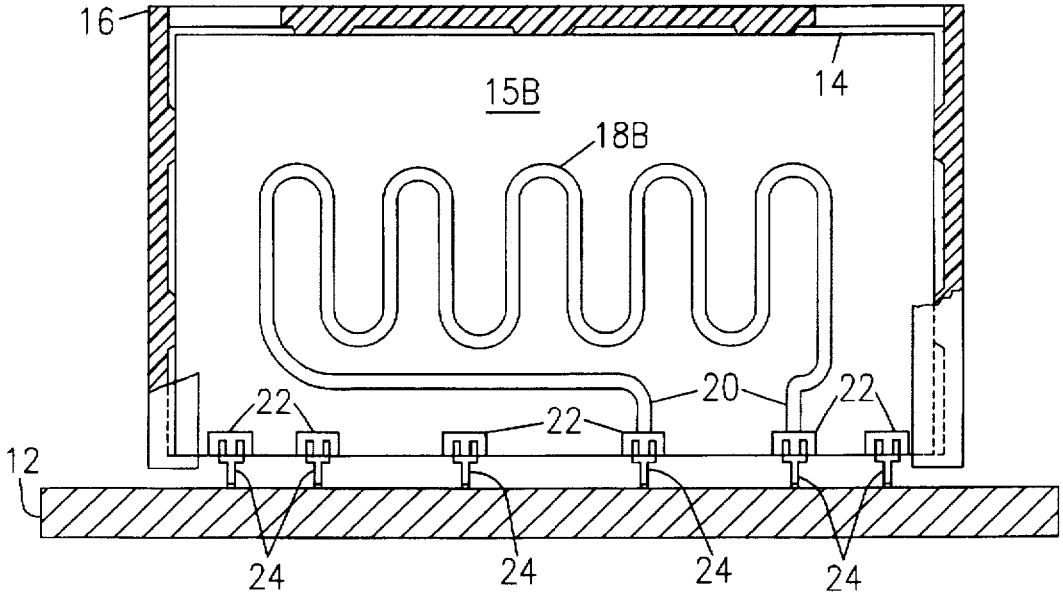
FIG. 7

SURFACE MOUNT FUSING DEVICE

BACKGROUND OF THE INVENTION

This invention relates to the field of electrical fusing devices. More particularly, the present invention relates to a thermal fuse or switch that is configured as a surface mount device, for use in such applications as over-current protection in telecommunication line cards employing line feed resistors.

Thermal fuses for over-current protection and similar applications are well known in the electrical and electronic arts. (For the purposes of this discussion, the term "thermal fuse" will be deemed to encompass both non-resettable and resettable devices, the latter being more properly termed "thermal switches".) Examples of such devices are disclosed in the following U.S. Pat. Nos.: 3,763,454—Zandonatti; 3,995,246—Morgan; 4,494,104—Holmes; 4,533,896—Belopolsky; 5,084,691—Lester et al.; 5,097,247—Doerrwaechter; 5,192,937—Lee; 5,193,044—Czerwiec; 5,280,262—Fischer; and 5,363,083—Fischer.

As the trend in electronic circuitry is toward increased miniaturization, ways are constantly being sought to achieve more efficient use of space on circuit boards and cards. One such technique that has become commonplace is the use of "surface mount" electronic components in place of "through-hole" components. Another technique is to configure the components themselves so that they can be more densely packed into a given surface area, not just by reducing their overall size, but by also reducing the particular dimension that occupies board or card space. Thus, for example, a component that has a relatively flat, planar configuration may be installed so that its plane is tangential to the plane of the board, rather than parallel to it.

One problem with typical prior art thermal fuse devices is that they are not readily amenable to surface mount installation. This is because the standard reflow soldering process used for surface mount installation would frequently cause the thermal fuse to open prematurely. Some surface mount thermal fuse devices have, nevertheless, been designed, as exemplified by the above-mentioned U.S. Pat. Nos. 5,280,262 and 5,363,083. These prior art surface mount thermal fuse devices are generally rather complicated to manufacture, and they occupy a relatively large amount of space on the circuit board or card.

There has thus been a long-felt, but as yet unfulfilled need for a surface mount thermal fuse device for over-current protection that is relatively simple to manufacture, and that occupies a minimum of board space.

SUMMARY OF THE INVENTION

Broadly, the present invention is a thermal fuse device for over-current protection that is surface-mountable on a circuit board, and that includes a fusing element comprising a conductive metal strip that is formed into a mechanical rocker configuration with a fulcrum point between first and second ends. The fuse strip is connected to first and second terminal pads on a dielectric substrate by a first solder joint between the first end and the first terminal pad, and a second solder joint between the fulcrum point and the second terminal pad, connecting the first and second pads electrically. The second end of the strip is resiliently pressed against the interior surface of an insulative housing that holds the substrate perpendicularly to the plane of the circuit board, and that provides for surface mount installation of the substrate on the board. The pressure applied to the second end of the fuse strip by the housing applies an inwardly-directed (toward the substrate) force to the second end of the strip. This force is resisted by the substrate through the first and second solder joints, whereby the fuse strip remains immobile.

A resistive element on the substrate near the fusing element generates heat in response to the flow of current. When the current is greater than a predetermined current value, the generated heat is sufficient to melt the first and second solder joints. When the solder joints melt, the fuse strip is allowed to pivot about its fulcrum point in response to the inwardly-directed force applied to the second end of the fuse strip by the housing, thereby causing the first end of the fuse strip to lift away and separate from the first terminal pad, and thereby opening the circuit. The predetermined current value is selected to protect against over-current conditions.

In a preferred embodiment,, the housing is configured as a bracket that holds two or more of the above-described substrates in a substantially parallel relationship to each other and in a substantially perpendicular relationship to the circuit board, whereby the substrates, provided with terminal leads configured for surface mount installation, can be installed on the board in an upright (vertical) orientation, thus minimizing the amount of board space they occupy. The housing advantageously includes an upper surface with an aperture that allows the state of the fusing element (tripped or untripped) to be easily viewed.

The present invention offers significant advantages over prior art over-current fusing devices. First, as mentioned above, it allows for very efficient use of board space, by virtue of its perpendicular orientation and its surface mount configuration. In addition, the fusing element is not susceptible to tripping until the device is finally assembled, thereby simplifying the manufacturing process. Furthermore, as also mentioned above, a positive visual indication of the state of the device is offered. Moreover, the device, is both simple and economical to manufacture, and easy to install in a variety of applications, including, but not limited to, telecommunication line cards employing line feed resistors.

BRIEF DESCRIPTION OF THE DRAWINGS

FIG. 2 is a side elevational view, partially broken away, of one of the fusing devices of FIG. 1, showing the outwardly-facing surface of one of the substrates used in the device;

FIG. 7 is a side elevational view, partially broken away, of one of the fusing devices of FIG. 1, showing the inwardly-facing surface of one of the substrates used in the device;

DETAILED DESCRIPTION OF THE PREFERRED EMBODIMENT

Figure 1:
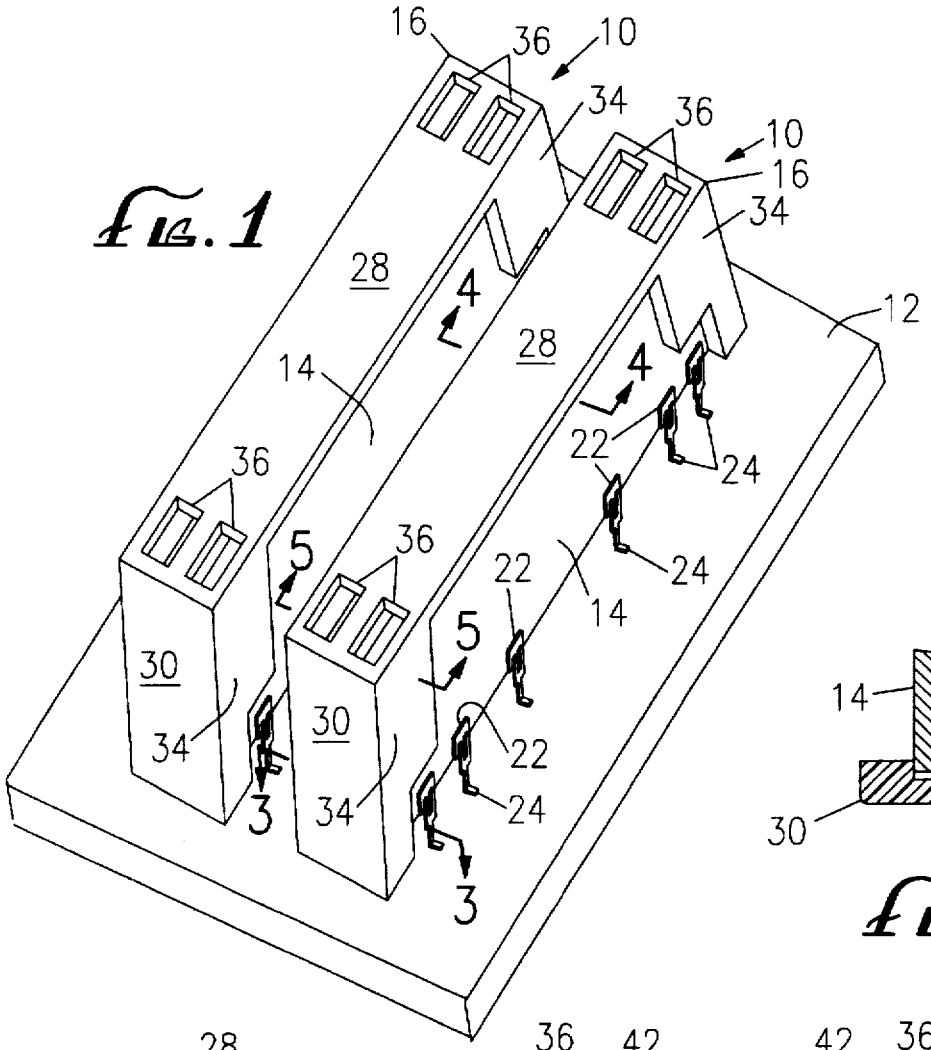
FIG. 1 is a perspective view of two fusing devices, in accordance with a preferred embodiment of the present invention, showing the devices mounted on a circuit board.

Referring now to the drawings, FIG. 1 shows two fusing devices 10, in accordance with a preferred embodiment of the present invention, mounted on a circuit board 12. Each of the fusing devices 10 comprises a pair of dielectric substrates 14 mounted in an insulative housing 16. Each of the substrates has a pair of opposed major surfaces: an outwardly-facing surface 15A (FIG. 2), and an inwardly-facing surface 15B (FIG. 7). The substrates 14 would typically carry on them a number of electronic components (not shown) that are to be electrically connected into a circuit (not shown) on the circuit board 12. Included among these components is a first serpentine resistive element **18*a* on the outwardly-facing surface 15A, and a second serpentine resistive element 18*b* on the inwardly-facing surface 15B. The resistive elements 18*a*, 18*b*** generate heat in response to the flow of electric current though them, as will be described more fully below.

The electronic components, including the resistive elements **18*a*, 18*b*, on each of the substrates 14 are connected, via conductive traces 20, to a plurality of terminal pads 22 that are located at spaced intervals on one of the major surfaces of each substrate 14, near one edge thereof. Attached to each of the terminal pads 22 is one end of a terminal lead 24**, the other end of which is bent outwardly at approximately a 90° angle in the configuration of a surface mount termination.

The substrates 14 are mounted, preferably in pairs, in the insulative housing 16. The housing 16 is configured as a bracket that holds a pair of substrates 14 in a substantially parallel relationship with each other, and in a substantially perpendicular orientation with respect to the board 12. The housing 16 includes a top portion 28 connecting a pair of opposed end portions 30. The two substrates 14 are retained in the housing by means of a pair of parallel slots or tracks 32 formed in the interior surfaces of the top portion 28 and the end portions 30. When positioned in the housing 16, each of the substrates 14 has its outwardly-facing surface 15A facing outwardly, and its inwardly-facing surface 15B facing inwardly, toward the inwardly-facing surface 15B of the other substrate 14 in the housing.

Each of the end portions 30 includes a pair of opposed side wall sections 34, each of which covers a portion of the outwardly-facing surface 15A of the adjacent one of the substrates 14, and is contiguous with the top portion 28. The top portion 28 has a pair of apertures 36 near its juncture with each of the end portions 30. The purpose of the apertures 36 will be explained below.

A pair of metal fusing elements 38 is mounted on the outwardly-facing surface **15*a* of each of the substrates 14, so as to extend into the space between the outwardly-facing surface 15A and the adjacent side wall section 34. Each of the fusing elements 38 comprises a conductive metal strip that is formed into a mechanical rocker configuration. Each fusing element 38 has a first end 40 attached by a first solder junction to a first fusing element terminal pad 42 on the substrate 14, and a fulcrum point 44 attached by a second solder junction to a second fusing element terminal pad 46. Each fusing element 38 thus electrically connects one of the first fusing element terminal pads 42 to one of the second fusing element terminal pads 46. A second end 48 of each of the fusing elements 38 is resiliently pressed against the interior surface of the adjacent one of the housing side wall sections 34, thereby resulting in a pressure being applied to the second end 48 of the fusing element 38 by the housing 16**.

Each of the fusing elements 38 is exposed to heat generated primarily by one of the heat-generating resistive elements **18*a*, 18*b*. Specifically, one of the fusing elements 38 is exposed primarily to heat generated by the first resistive element 18*a* on the outwardly-facing surface 15A of the substrate 14, while the other fusing element 38 is exposed to heat generated primarily by the second resistive element 18*b* on the inwardly facing surface 15B. At a predetermined current value, the generated heat is sufficient to melt the solder at the first and second solder junctions, whereby the pressure applied against the second end 48 of the fusing element 38 causes the fusing element 38 to pivot about its fulcrum point 44 to lift the first end 40 of the fusing element 38 away from the first terminal pad 42, thereby separating the first end 40 from the first terminal pad 42** to open the circuit. The predetermined current value is selected to protect against over-current conditions.

Figure 5:
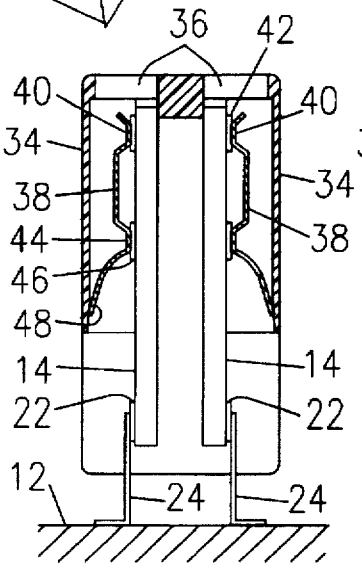
FIG. 5 is a cross-sectional view taken along line 5—5 of FIG. 1, showing the fusing devices in their untripped (closed) state.
Figure 6:
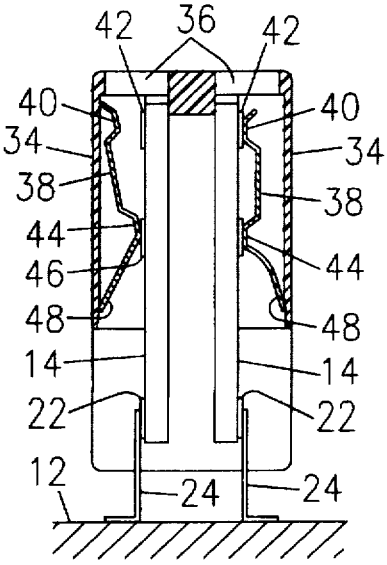
FIG. 6 is a cross-sectional view, similar to that of FIG. 5, but showing one of the fusing devices in its tripped (open) state.

The operation of the present invention is illustrated in FIGS. 5 and 6, which show a fusing device 10 comprising a pair of substrates 14 mounted, as described above, in a housing 16, in a parallel, back-to-back relationship, each of the substrates 14 having a fusing element 38 installed on its outwardly-facing surface 15A, as described above. In FIG. 5, both of the illustrated fusing elements 38 are closed (untripped). That is, the solder junctions connecting the first fusing element end 40 to the first fusing element terminal pad 42, and the fulcrum point 44 to the second fusing element terminal pad 46, are both intact, providing an electrical connection between the two terminal pads 42, 46 by means of the fusing element 38.

In response to an over-current condition, the situation illustrated in FIG. 6 obtains. The heat generated by one of the heat-generating resistive elements **18*a*, 18*b* on the left-hand substrate 14 (as shown in FIG. 6) has melted the solder at the two above-described solder junctures. As a result of the pressure applied to the second end 48 of the fusing element 38 by the interior surface of the housing 16, the fusing element 38 pivots about its fulcrum point 44 to separate its first end 40 from the first fusing element terminal pad 42, thereby opening the circuit in which the terminal pads 42, 46** are included.

The apertures 36 in the top portion 28 of the housing 16 provide a visual indication of the state (tripped or untripped) of each of the fusing elements 38.

Figure 3:
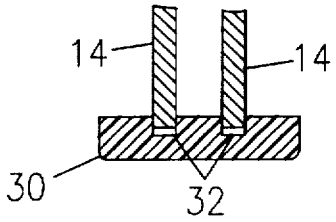
FIG. 3 is a cross-sectional view taken along line 3—3 of FIG. 1.
Figure 4:
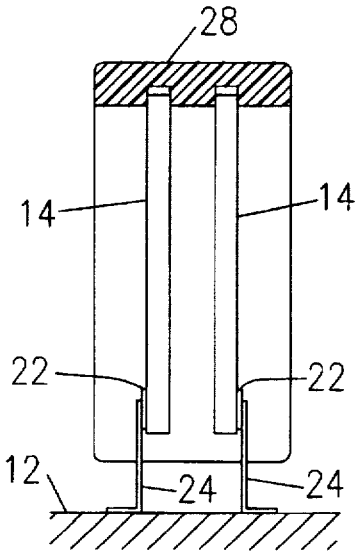
FIG. 4 is a cross-sectional view taken along line 4—4 of FIG. 1.
Figure 8:
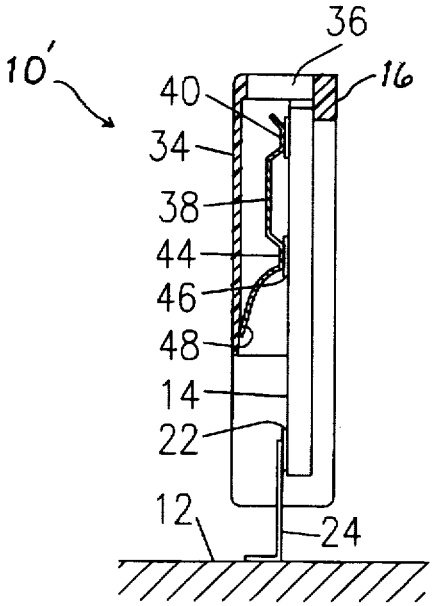
FIG. 8 is a cross-sectional view, similar to that of FIG. 5, showing a single-substrate modification of the preferred embodiment of the invention, with the fusing device in the untripped (closed) state.
Figure 9:
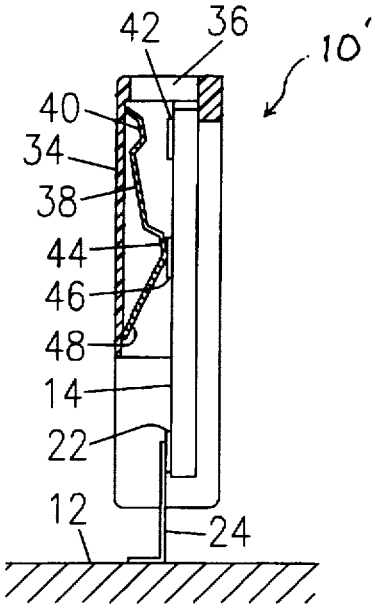
FIG. 9 is a cross-sectional view of the modified preferred embodiment of FIG. 8, showing the fusing device in the tripped (open) state.

FIGS. 8 and 9 illustrate a modification of the preferred embodiment, in which a fusing device 10' comprises a single one of the dielectric substrates 14 described above. The single substrate 14 has a first major surface 15A (FIG. 2) and a second major surface 15B (FIG. 3) that include all of the features described above, including the resistive elements **18*a*, 18*b*, the conductive traces 20, the terminal pads 22, the terminal leads 24. The substrate is mounted in an insulative housing 16 having a top portion with an aperture 36 therein, and a side wall portion 34 that covers a portion of the first major surface 15A of the substrate 14. A fusing element 38, like that described above, is mounted on the first major surface 15A. Each fusing element 38 has a first end 40 attached by a first solder junction to a first fusing element terminal pad 42 on the substrate 14, and a fulcrum point 44 attached by a second solder junction to a second fusing element terminal pad 46. A second end 48 of the fusing element 38 is resiliently pressed against the interior surface of the adjacent side wall section 34, thereby resulting in a pressure being applied to the second end 48 of the fusing element by the housing 16**.

The fusing element 38 in the modified preferred embodiment of FIGS. 8 and 9 functions as described above in conjunction with FIGS. 5 and 6. Thus, FIG. 8, like FIG. 5, illustrates the untripped (closed) state of the fusing element 38, and FIG. 9, like FIG. 6, shows the fusing element 38 in its tripped (open) state. The state of the fusing element 38 can be viewed through the aperture 36.

From the foregoing description, it will be appreciated that the present invention offers significant advantages over prior art over-current fusing devices. First, its perpendicular orientation and its surface mount configuration provide for very efficient use of board space. In addition, the fusing element 38 is not susceptible to tripping until the device is finally assembled and installed, thereby simplifying the manufacturing process. Furthermore, a positive visual indication of the state of the device (tripped or untripped) is provided. Moreover, the device is both simple and economical to manufacture, and easy to install in a variety of applications, including, but not limited to, telecommunication line cards employing line feed resistors.

Although a preferred embodiment has been described herein, it will be appreciated that a number of variations and modifications may suggest themselves to those skilled in the pertinent arts. For example, while the preferred embodiment of the invention employs a pair of substrates mounted in a parallel, back-to-back relationship, the invention contemplates embodiments with only one substrate, or with more than two. Furthermore, while the preferred embodiment employs two fusing elements per substrate, the number employed may be one or three or more. Moreover, the specific configurations of the fusing element and/or the resistive elements may be varied from those shown in the drawings and described above. Likewise, the housing configuration and the means for mounting the substrates in the housing may assume a variety of forms. These and other variations and modifications that may suggest themselves should be considered within the spirit and scope of the invention, as defined in the claims that follow.

What is claimed is:

1. A fusing device, comprising:

a housing having a wall portion with an interior surface;

a substrate disposed within the housing;

first and second terminal pads on the substrate;

a fusing element having a first end attached to the first terminal pad by a first solder junction, a fulcrum point attached to the second terminal pad by a second solder junction, and a second end resiliently pressed against the interior surface of the housing wall portion so as to apply a pressure against the second end of the fusing element; and a heat-generating resistive element disposed on the substrate;

whereby, in response to a current flowing through the resistive element that is greater than a predetermined current value, the resistive element generates sufficient heat to melt the first and second solder junctions, and whereby the pressure applied to the second end of the fusing element causes the fusing element to pivot about the fulcrum point to lift the first end of the fusing element away from the first terminal pad.

2. The fusing device of claim 1, wherein the fusing element has a first position before the first end is separated from the first terminal pad, and a second position after the first end is separated from the first terminal pad, and wherein the device further comprises indication means for providing a visual indication of the position of the fusing element from outside of the housing.

3. The fusing device of claim 2, wherein the indication means includes an aperture in the housing through which the fusing element is visible.

4. The fusing device of claim 3, wherein the housing includes an upper surface having a plane that is orthogonal to the plane of the substrate, and wherein the aperture is in the upper surface.

5. The fusing device of claim 1, further comprising:

mounting means on the substrate for permitting a surface-mount installation of the device on a circuit board.

6. The fusing device of claim 5, wherein the substrate has first and second opposed major surfaces, and wherein the substrate is retained in the housing so that, when the device is surface-mounted on a circuit board, the planes of the major surfaces are substantially perpendicular to the plane of the circuit board.

7. A fusing device, comprising:

a housing;

first and second substrates retained in the housing in a substantially parallel orientation, each of the substrates having an inner surface and an outer surface, the inner surfaces of the substrates facing each other;

first and second terminal pads on the outer surface of each of the substrates;

a fusing element disposed on the outer surface of each of the substrates so as to connect the first and second terminal pads, the fusing elements each comprising a metallic strip having a first end attached to the first terminal pad by a first solder junction, a fulcrum point attached to the second solder pad by a second solder junction, and a second end resiliently pressed against the housing so as to apply pressure on the second end; and a heat-generating resistive element disposed on each of the substrates;

whereby, in response to a current flowing through the resistive element that is greater than a predetermined current value, the resistive element generates sufficient heat to melt the solder at the first and second solder junctions, and whereby the pressure applied to the second end causes the strip to pivot about the fulcrum point so as to separate the first end from the first terminal pad.

8. The fusing device of claim 7, wherein each of the metallic strips has a first position before the first end is separated from the first terminal pad, and a second position after the first end is separated from the first terminal pad, and wherein the device further comprises indication means for providing a visual indication of the position of the metallic strip from outside of the housing.

9. The fusing device of claim 8, wherein the indication means includes an aperture in the housing through which the fusing element is visible.

10. The fusing device of claim 9, wherein the housing includes an upper surface having a plane that is orthogonal to the plane of the substrate, and wherein the aperture is in the upper surface.

11. The fusing device of claim 7, further comprising:

mounting means on each of the substrates for permitting a surface-mount installation of the device on a circuit board.

12. The fusing device of claim 11, wherein the first and second substrates are retained in the housing so that, when the device is surface-mounted on a circuit board, the planes of the inner and outer surfaces of the first and second substrates are substantially perpendicular to the plane of the circuit board.

13. A fusing device, comprising:

a housing having a side wall portion and a top portion with an aperture;

a substrate disposed within the housing and having a first and second planar surfaces;

first and second terminal pads on the first planar surface of the substrate;

a heat-generating resistive element disposed on at least one of the planar surfaces of the substrate; and a fusing element disposed on the first planar surface of the substrate, the fusing element comprising:

a first end attached by a first solder junction to the first terminal pad;

a fulcrum point attached by a second solder junction to the second terminal pad; and a second end pressed against the side wall portion so as to apply pressure to the second end;

whereby, in response to a current flowing through the resistive element that is greater than a predetermined current value, the resistive element generates sufficient heat to melt the first and second solder junctions, and whereby the pressure applied to the second end causes the fusing element to pivot about the fulcrum point so as to separate the first end from the first terminal pad.

14. The fusing device of claim 13, further comprising:

mounting means on the substrate for providing a surface mount installation of the device on a circuit board.

15. The fusing device of claim 14, wherein the substrate is retained in the housing so that, when the device is surface-mounted on a circuit board, the planes of the planar surfaces are substantially perpendicular to the plane of the circuit board.

16. The fusing device of claim 13, wherein the fusing element has a first position before the first end is separated from the first terminal pad, and a second position after the first end is separated from the first terminal pad, and wherein the device further comprises indication means for providing a visual indication of the position of the fusing element from outside of the housing.

17. The fusing device of claim 16, wherein the indication means includes the aperture.

* * * * *